United States Patent [19]

Johanson

[11] Patent Number: 4,986,456

[45] Date of Patent: Jan. 22, 1991

[54] FLOW RATE CONTROLLER AND FEEDER

[75] Inventor: Jerry R. Johanson, San Luis Obispo, Calif.

[73] Assignee: JR Johanson, Inc., San Luis Obispo, Calif.

[21] Appl. No.: 446,058

[22] Filed: Dec. 5, 1989

[51] Int. Cl.[5] ..... B65D 47/00

[52] U.S. Cl. ..... 222/561; 222/564; 406/124; 406/146

[58] Field of Search ..... 222/195, 330, 460, 485, 222/561, 564, 565; 406/124, 146

[56] References Cited

U.S. PATENT DOCUMENTS

| | | | |
|---|---|---|---|
| 2,891,782 | 6/1959 | Blackman et al. | 406/146 |
| 3,066,831 | 12/1962 | Thompson | 222/330 |
| 3,841,530 | 10/1974 | Janninck | 406/146 |
| 3,858,943 | 1/1975 | Bose et al. | 406/124 |
| 4,040,530 | 8/1977 | Mahr et al. | 222/564 |

FOREIGN PATENT DOCUMENTS

| | | | |
|---|---|---|---|
| 672641 | 4/1901 | Fed. Rep. of Germany | 222/561 |

*Primary Examiner*—Andres Kashnikow
*Assistant Examiner*—Pamela Jordan
*Attorney, Agent, or Firm*—Daniel C. McKown

[57] ABSTRACT

The discharge rate of a solid particulate material from a storage hopper is increased beyond the rate attainable by gravity flow along through the introduction of a pressurized gas into a plenum that lies over the discharge hopper. In one embodiment, a first pipe extends vertically downward from a storage hopper, and a second pipe of larger diameter is fitted over the lower end of the first pipe so that an annular plenum is formed between the pipes. A pressurized gas is injected into this plenum and results in an increase in the discharge rate. The discharge rate can be controlled by altering the pressure of the injected gas, and the flow can be rendered intermittent by opening and closing a gate valve at the outlet of the discharge hopper.

15 Claims, 3 Drawing Sheets

FLOW RATE CONTROLLER AND FEEDER

BACKGROUND OF THE INVENTION

1. Field of the Invention

The present invention is in the field of material handling systems and specifically relates to apparatus for controlling the rate of discharge of a solid particulate material from a storage hopper.

2. The Prior Art

There has long been a need for apparatus for accurately controlling the discharge rate of particulate materials from a storage hopper. Sometimes the discharge from the outlet of a storage hopper will be used to fill one or more containers, or to provide a continuing flow into a continuous processing unit. At other times, there is a need to control the flow rate at will.

The most common way of controlling the discharge is by the use of a screw, belt or vibrating pan feeder. Sometimes a valve located in the outlet of the storage hopper is used for a crude control. In some instances, a less expensive variable aperture such as a "V" slot ball valve, partially-opened butterfly valve or knife gate is used to modulate the flow.

Several problems are common to the use of aperture-limiting valves. Because the aperture is limited, the material to be discharged may form an arch, bridge or rathole above the limited aperture thereby choking off the flow altogether. Although such flow obstructions may be broken by mechanical means, the resulting intermittent and unpredictable flow is highly undesirable for most applications.

A second major limitation of limited-aperture controllers is that the discharge rate at best cannot exceed the rate produced by gravity flow through the maximum aperture. For such controllers, gravity sets the maximum rate of discharge.

Thus, the more common techniques of controlling the discharge rate are not altogether satisfactory, and the present invention is intended to overcome this problem.

SUMMARY OF THE INVENTION

It is an object of the present invention to provide apparatus that will permit the discharge rate to be controlled with greater accuracy and over a wider range of discharge rates than was heretofore possible.

It is a further object of the present invention to provide apparatus for achieving controlled flow rates greater than the flow rate provided by the action of gravity alone.

In accordance with the present invention, a vertical pipe is attached to the existing outlet of the storage hopper so as to receive particulate material from the existing storage hopper. A second vertical pipe, of diameter larger than the first vertical pipe is brought up over the lower end of the first vertical pipe and is sealed to the first vertical pipe so that an annular plenum is formed by the space between the first and second pipes. A mass-flow hopper, i.e., one that is steep enough to cause flow at the hopper walls, is attached to the lower end of the second pipe, and the outlet of the mass-flow hopper includes a valve that is used to control the flow rate of discharge from the mass-flow hopper. Air under pressure is introduced to the annular plenum through a feeder attached to the second pipe in a preferred embodiment or attached to the top of the plenum in an alternative embodiment. A pressure regulator is used to control the air pressure supplied to the feeder pipe. In an alternative embodiment, the mass-flow hopper is of a type known in the art as a cone-in-cone mass flow hopper.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
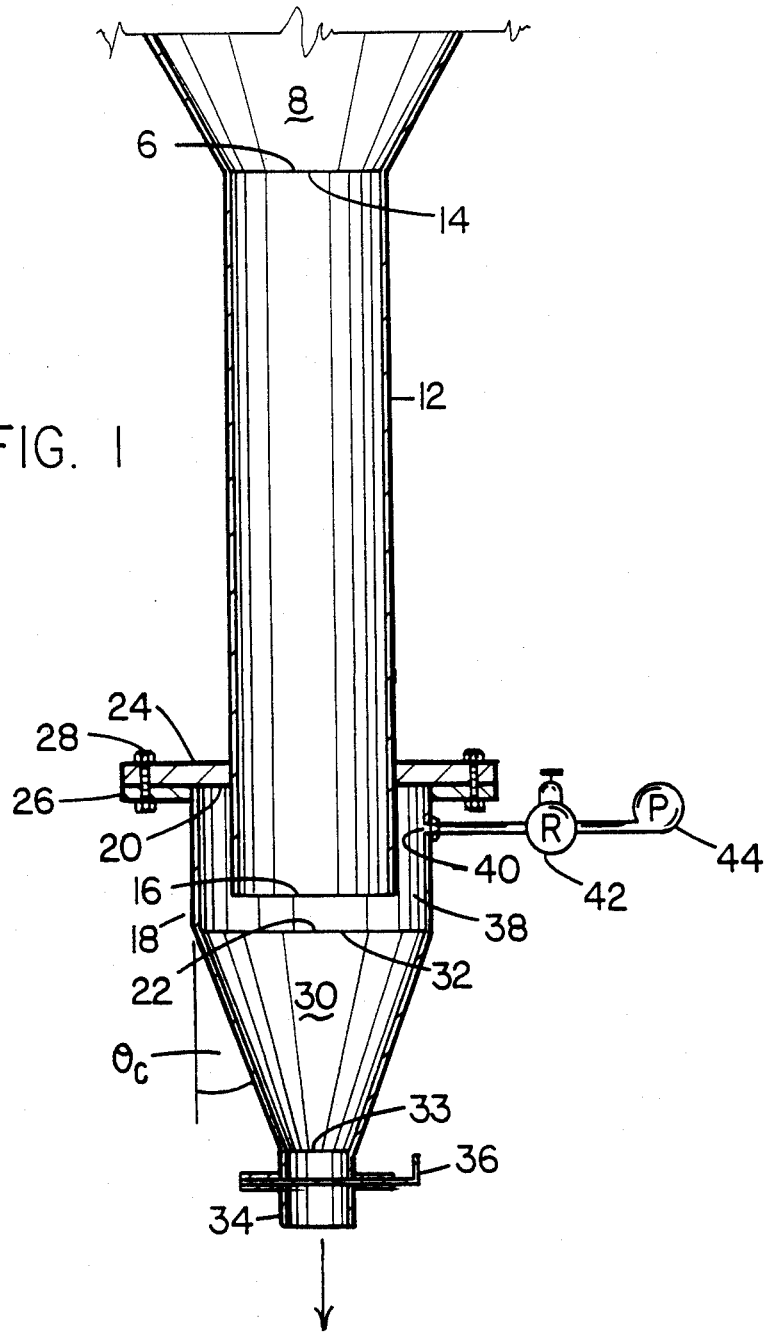
FIG. 1 is a side elevational view in cross section showing a preferred embodiment of the flow rate controller.

So far as possible, the same reference numerals will be applied to like parts in the various embodiments. In the preferred embodiment of FIG. 1, a storage bin 8 normally contains a quantity of a solid particulate material, which may be anything from a fine powder to a coarse material such as coal or ore. In some instances, the material may be dry, but in other instances it may be somewhat moist.

In accordance with the present invention, the upper end 14 of a first pipe 12 is connected to the lower end 6 of the storage bin 8. In the preferred embodiment, a flange 24 encircles the first pipe 12 a short distance from the lower end 16 of the first pipe 12. In accordance with the present invention, this first pipe 12 must not converge downwardly, although it may diverge downwardly.

A second pipe 18 having a flange 26 at its upper end 20 is brought up over the lower end 16 of the first pipe, and the flanges 24, 26 are fastened together by bolts, of which the bolt 28 is typical. In this position, the upper end 20 of the second pipe 18 is higher than the lower end 16 of the first pipe 12. The lower end 16 of the first pipe is above the lower end of the second pipe in the preferred embodiment of FIG. 1, but in other embodiments, the lower end 16 of the first pipe may be slightly lower than the lower end 22 of the second pipe.

When the flanges 24, 26 have been fastened together, a substantially airtight seal is formed between the first and second pipes. An annular plenum 38 is thus formed by the space between the first pipe 12 and the second pipe 18.

A mass flow hopper 30 is attached by its upper end 32 to the lower end 22 of the second pipe 18. An outlet 34 is attached to the lower end 33 of the mass flow hopper.

Figure 2:
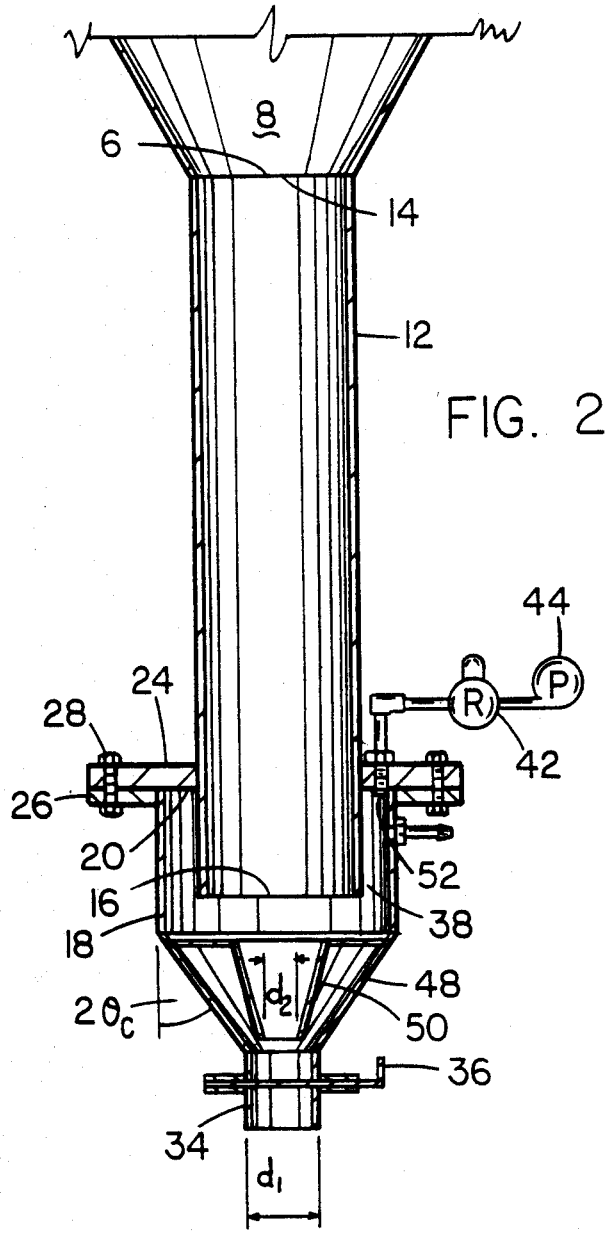
FIG. 2 is a side elevational view in cross section showing an alternative embodiment of the present invention.

The outlet 34 is provided with a slide gate valve 36 that can be operated by the user to shut off the flow of materials, or, as will be seen in connection with the embodiment of FIG. 2, to control the flow rate in part.

In the preferred embodiment of FIG. 1, the second pipe 18 is provided with an inlet 40 to permit a gas under pressure to be introduced into the plenum 38. In the preferred embodiment, the gas is air, but in other embodiments, other gases are used. In the embodiment of FIG. 1, the pressure of the gas is controlled by the regulator 42 which is operated by the user, and the air pump 44 serves as a source of pressurized gas.

In operation, the user wishing to discharge some material first opens the slide gate valve 36 and then gradually increases the gas pressure by adjusting the pressure regulator 42.

The theory of the design of the mass flow hopper 30 is well developed, as noted above. It is sufficient here to note that the semiapex angle of the conical mass flow hopper 30 must not exceed a critical angle $\theta_c$ if mass flow under the action of gravity is to be expected.

The embodiment of FIG. 2 differs from that of FIG. 1 in several respects.

In the embodiment of FIG. 2, the air inlet 52 is located at the upper end of the plenum 38.

In the embodiment of FIG. 2, a cone-in-cone mass flow hopper 48 is used. From a structural standpoint it differs from the hopper 30 of FIG. 1 in that it includes a hollow truncated cone 50 that is mounted within the hopper so as to be coaxial with the hopper. Further, the presence of the cone 50 permits the angle of the wall of the hopper 48 to be larger than $\theta_c$, but not greater than 2 $\theta_c$. This has the advantage of reducing the height of the hopper.

Figure 3:
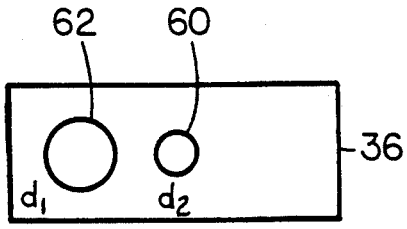
FIG. 3 is a plan view showing the apertures in the gate valve used in the embodiment of Figure; and, FIG. 4 is a side elevational view in cross section showing another alternative embodiment of the present invention.

The presence of the cone 50 permits closer control of the discharge rate. As seen in FIG. 3, the slide gate valve 36 includes a first hole 60 of diameter $d_2$ equal to the diameter of the lower end of the cone 50, and also includes a second hole 62 whose diameter corresponds to the diameter $d_1$ of the lower end of the hopper 48. When closely controlled but relatively low flow rates are desired, the gate 36 is positioned so that the hole 60 is concentric with the axis of the hopper 48. In this position, most of the material discharged flows through the cone 50. When a faster discharge rate is desired, the gate 36 is moved to a position at which the hole 62 is concentric with the axis of the hopper 48. In this position, some of the discharged material passes through the cone 50, while the remainder of the material flows around the cone 50. The holes 60 and 62 provide for, respectively, a low range of discharge rates and a high range of discharge rates. Within each of these ranges, the discharge rate may be closely controlled by the operator by adjusting the gas pressure supplied to the plenum 38. It is considered to be within the scope of the invention to modulate the gas pressure to modulate the discharge rate and to open and close the gate 36 when discrete amounts of material are being discharged in succession, as for example when filling bags or containers.

Figure 4:
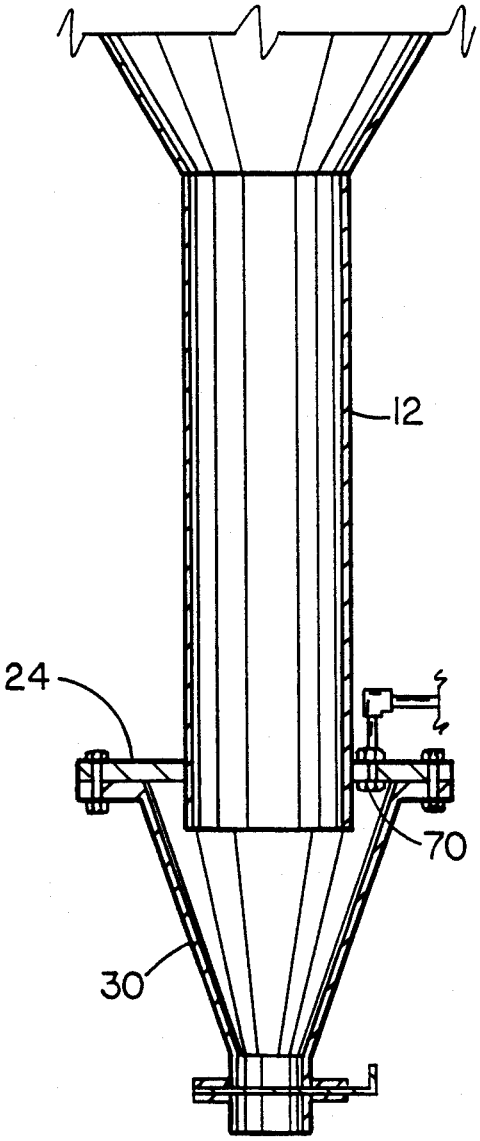

FIG. 4 shows another alternative embodiment of the present invention, wherein the length of the second pipe of the other embodiments is zero, and the mass flow hopper 30 is attached directly to the flange 24 of the first pipe 12. Pressurized air is supplied to the upper portion of the mass flow hopper by the inlet 70 which may be attached to the flange 24 as shown in FIG. 4 or which may be attached to the conical wall of the mass flow hopper.

Thus, there has been described a preferred embodiment and an alternative embodiment of an apparatus for controlling the flow rate of solid particulate material from a storage hopper. It has been found that the use of gas pressure will increase the flow rate above that obtainable by gravity alone, while producing a steady and controlled discharge, uninterrupted by arching, bridging or ratholing of the particulate material.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. Apparatus for use in controlling the flow rate of solid particulate material from a storage hopper, comprising in combination:

a first pipe having an upper end connected to the bottom of the storage hopper for receiving solid particulate material from it, extending vertically downward to a lower end, but not converging downwardly;

a second pipe, of larger diameter than said first pipe, extending vertically downward from an upper end to a lower end, the upper end of said second pipe being higher than the lower end of said first pipe so that a space of annular cross section is defined between said first pipe and said second pipe;

first means sealingly engaging said first pipe and said second pipe and forming an upper boundary to the space of annular cross section;

a mass flow hopper having an upper end that is attached to the lower end of said second pipe, the space of annular cross section opening downwardly into said mass flow hopper, said mass flow hopper converging downwardly from its upper end to a lower end;

an outlet affixed to the lower end of said mass flow hopper and including second means for controlling the flow of the solid particulate material from said mass flow hopper; and, third means connected to said second pipe for supplying air under pressure to the space of annular cross section.

2. The apparatus of claim 1 wherein said second means further comprise a gate valve.

3. The apparatus of claim 1 wherein the lower end of said second pipe is lower than the lower end of said first pipe.

4. The apparatus of claim 1 wherein the lower end of said second pipe is higher than the lower end of said first pipe.

5. The apparatus of claim 1 wherein said mass flow hopper is a cone-in-cone mass flow hopper which further comprises a cone mounted within said mass flow hopper, converging downwardly, and positioned to discharge some of the solid particulate material through the outlet.

6. The apparatus of claim 5 wherein said second means is a three-position gate valve having a first position in which it prevents discharge of the solid particulate material from said outlet, having a second position in which it limits the discharge to predominately solid particulate material that has passed through the cone, and having a third position in which it passes solid particulate material that flows past the cone in addition to solid particulate material that has passed through the cone.

7. Apparatus for use in controlling the flow rate of solid particulate material from a storage hopper, comprising in combination:

a first pipe having an upper end connected to the bottom of the storage hopper for receiving solid particulate material from it, extending vertically downward to a lower end, but not converging downwardly;

a second pipe, of larger diameter than said first pipe, extending vertically downward from an upper end to a lower end, the upper end of said second pipe being higher than the lower end of said first pipe so that a space of annular cross section is defined between said first pipe and said second pipe;

first means sealingly engaging said first pipe and said second pipe and forming an upper boundary to the space of annular cross section;

a mass flow hopper having an upper end that is attached to the lower end of said second pipe, the space of annular cross section opening downwardly into said mass flow hopper, said mass flow hopper converging downwardly from its upper end to a lower end;

an outlet affixed to the lower end of said mass flow hopper and including second means for controlling the flow of the solid particulate material from said mass flow hopper; and, third means connected to said first means for supplying air under pressure to the space of annular cross section.

8. The apparatus of claim 7 wherein said second means further comprise a gate valve.

9. The apparatus of claim 7 wherein the lower end of said second pipe is lower than the lower end of said first pipe.

10. The apparatus of claim 7 wherein the lower end of said second pipe is higher than the lower end of said first pipe.

11. The apparatus of claim 7 wherein said mass flow hopper is a cone-in-cone mass flow hopper which further comprises a cone mounted within said mass flow hopper, converging downwardly, and positioned to discharge some of the solid particulate material through the outlet.

12. The apparatus of claim 11 wherein said second means is a three-position gate valve having a first position in which it prevents discharge of the solid particulate material from said outlet, having a second position in which it limits the discharge to predominately solid particulate material that has passed through the cone, and having a third position in which it passes solid particulate material that flows past the cone in addition to solid particulate material that has passed through the cone.

13. The apparatus of claim 7 wherein the length of said second pipe is approximately zero.

14. Apparatus for use in controlling the flow rate of solid particulate material from a storage hopper, comprising in combination:

a first pipe having an upper end connected to the bottom of the storage hopper for receiving solid particulate material from it, extending vertically downward to a lower end but not converging downwardly;

a mass flow hopper having an upper end and a lower end, the lower end of said first pipe opening into said mass flow hopper;

first means sealingly engaging said first pipe and said mass flow hopper;

an outlet affixed to the lower end of said mass flow hopper and including second means for controlling the flow of the solid particulate material from said mass flow hopper; and, third means connected to said first means for supplying air under pressure to the space within said mass flow hopper adjacent its upper end.

15. Apparatus for use in controlling the flow rate of solid particulate material from a storage hopper, comprising in combination:

a first pipe having an upper end connected to the bottom of the storage hopper for receiving solid particulate material from it, extending vertically downward to a lower end but not converging downwardly;

a mass flow hopper having an upper end and a lower end, the lower end of said first pipe opening into said mass flow hopper;

first means sealingly engaging said first pipe and said mass flow hopper;

an outlet affixed to the lower end of said mass flow hopper and including second means for controlling the flow of the solid particulate material from said mass flow hopper; and, third means connected to said mass flow hopper for supplying air under pressure to the space within said mass flow hopper adjacent its upper end.

* * * * *